US008752817B2

(12) United States Patent
Kimura

(10) Patent No.: US 8,752,817 B2
(45) Date of Patent: Jun. 17, 2014

(54) RECORDING MEDIUM PROCESSING APPARATUS AND IMAGE FORMING SYSTEM

(75) Inventor: Masatoshi Kimura, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/543,444

(22) Filed: Jul. 6, 2012

(65) Prior Publication Data

US 2013/0009354 A1 Jan. 10, 2013

(30) Foreign Application Priority Data

Jul. 8, 2011 (JP) ..... 2011-151671

(51) Int. Cl.
*B65H 37/04* (2006.01)

(52) U.S. Cl.
USPC ..... 270/58.07; 270/58.08

(58) Field of Classification Search
USPC ..... 270/58.07, 58.08; 399/407, 408, 410
See application file for complete search history.

(56) References Cited

U.S. PATENT DOCUMENTS 6,719,283 B2 * 4/2004 Tsuchiya et al. ..... 270/58.07
7,552,917 B2 * 6/2009 Hayashi et al. ..... 270/58.12
7,913,990 B2 * 3/2011 Nakamura et al. ..... 270/58.11
2010/0140861 A1 * 6/2010 Kubota et al. ..... 270/58.08
2011/0081185 A1 4/2011 Motoi et al.

FOREIGN PATENT DOCUMENTS

JP 2005-254362 A 9/2005
JP 2011-079595 A 4/2011

* cited by examiner

*Primary Examiner* — Leslie A Nicholson, III
(74) *Attorney, Agent, or Firm* — Sughrue Mion, PLLC

(57) ABSTRACT

A recording medium processing apparatus includes: a first transportation route on which a recording medium is transported; a second transportation route branching from the first transportation route at a branch position; a transporting unit provided downstream of the branch position in a transport direction of the recording medium, the transporting unit (i) feeding at least a part of a first recording medium transported on the first transportation route and having passed through the branch position, into the second transportation route, (ii) transporting the fed first recording medium and a second recording medium with an overlap in the transport direction on the first transportation route to generate a bundle of the first and the second recording media and (iii) feeding the bundle which passed through the branch position into the second transportation route; and a punching unit provided on the second transportation route punching the fed bundle with one punching process.

11 Claims, 7 Drawing Sheets

RECORDING MEDIUM PROCESSING APPARATUS AND IMAGE FORMING SYSTEM

CROSS-REFERENCE TO RELATED APPLICATIONS

This application is based on and claims priority under 35 USC §119 from Japanese Patent Application No. 2011-151671 filed Jul. 8, 2011.

BACKGROUND

1. Technical Field

The present invention relates to a recording medium processing apparatus and an image forming system.

2. Related Art

There is known a sheet finishing apparatus in which a sheet transportation route for a punching process and a punching unit to perform the punching process on a sheet transported on the sheet transportation route are disposed.

SUMMARY

According to an aspect of the present invention, there is provided a recording medium processing apparatus including: a first transportation route on which a recording medium is transported; a second transportation route which branches from the first transportation route at a branch position; a transporting unit provided on a downstream side of the branch position in a transport direction of the recording medium, the transporting unit (i) feeding at least a part of a first recording medium, which is transported on the first transportation route and passed through the branch position, into the second transportation route, (ii) transporting the fed first recording medium and a second recording medium with an overlap in the transport direction on the first transportation route to generate a bundle of the fed first recording medium and the second recording medium and (iii) feeding the transported bundle which passed through the branch position into the second transportation route; and a punching unit that is provided on the second transportation route and punches the fed bundle with one punching process.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will be described below in detail with reference to the accompanying drawings.

Figure 1:
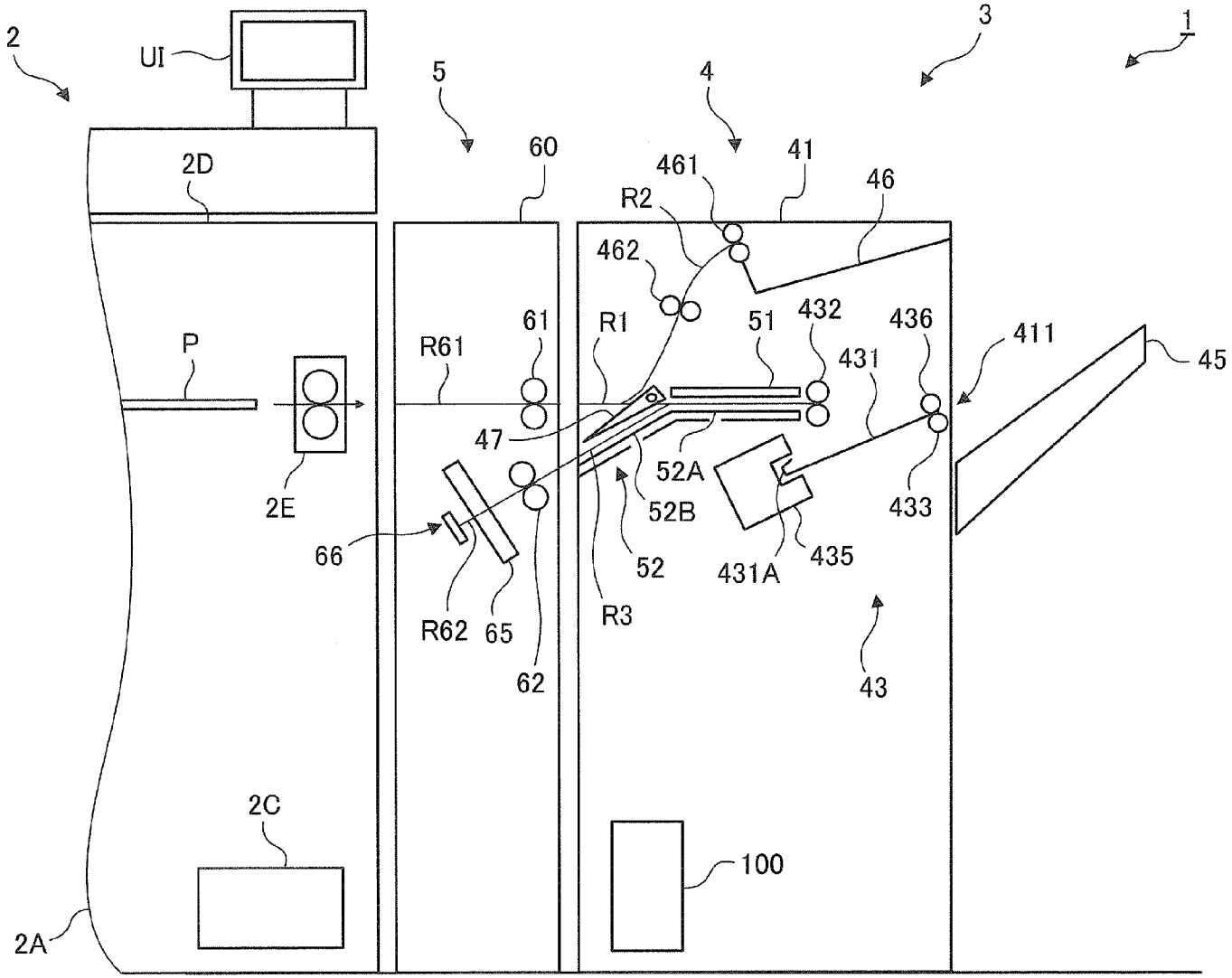
FIG. 1 is a diagram showing an entire configuration of an image forming system to which the exemplary embodiment is applied.

FIG. 1 is a diagram showing an entire configuration of an image forming system 1 to which the present exemplary embodiment is applied.

The image forming system 1 shown in FIG. 1 is provided with: an image forming apparatus 2 for forming a color image on a sheet P, which is an example of a recording medium, by an electrophotographic method, for example; and a processing apparatus 3 for performing a predetermined process on the sheet P discharged from the image forming apparatus 2.

The image forming apparatus 2 is provided with an image forming apparatus' main part 2A. The image forming apparatus 2 is also provided with a user interface (UI) that is composed of a liquid crystal display, for example, and that receives an instruction (input) from a user while displaying information for the user thereon. The image forming apparatus 2 also includes an image forming unit (not shown) for forming, for example, a toner image on a sheet P, inside of the image forming apparatus' main part 2A. The image forming apparatus 2 is also provided with a fixing device 2E for heating and pressurizing the sheet P to thereby fix the toner image on the sheet P, the toner image having been formed on the sheet P by the image forming unit. The image forming apparatus 2 is further provided with a sheet transporting mechanism (not shown) that includes a drive source such as a motor, and that transports the sheet P to the processing apparatus 3 by way of the image forming unit and the fixing device 2E. The image forming apparatus 2 is further provided with a controller 2C for controlling the above-described image forming unit, fixing device 2E, sheet transporting mechanism and UI in the image forming apparatus' main part 2A.

The above-described image forming unit provided for the image forming apparatus 2 may be composed of: a photoconductive drum; a charging device for charging the photoconductive drum; a laser exposing device for irradiating the photoconductive drum with a laser beam to form an electrostatic latent image; a developing device for developing, with a toner, the electrostatic latent image formed on the photoconductive drum; and a transfer device for transferring, onto a sheet P, a toner image formed on the photoconductive drum; for example. Note that the image may be formed by an ink-jet method or the like, although formation of an image by an electrophotographic method is illustrated in the present exemplary embodiment.

The processing apparatus 3 is provided with: a processing unit 4 for performing a predetermined process on a sheet P transported from the image forming apparatus 2; and a transportation unit 5 that is arranged between the processing unit 4 and the image forming apparatus 2, and that transports to the processing unit 4 the sheet P discharged from the image forming apparatus 2.

The processing unit 4 is provided with a housing 41 that has four side surfaces arranged so as to be perpendicular to one another and is formed into a rectangular parallelepiped. The processing unit 4 is also provided with an edge binder 43 for generating a bundle of sheets and performing a binding process on an edge of the bundle of sheets with a staple. The processing unit 4 is further provided with a controller 100. The controller 100 is capable of communicating with the controller 2C in the image forming apparatus 2, and controls a drive unit provided for the processing apparatus 3 (the processing unit 4 and the transportation unit 5). The processing unit 4 is also provided with a sheet stacking member 45 that is attached to a side surface of the processing unit 4. Sheets P discharged from the processing unit 4 are stacked on the sheet stacking member 45.

In an upper portion of the housing 41, the processing unit 4 is also provided with a sheet stacking portion 46 on which sheets P are stacked. The processing unit 4 is further provided with a first sheet transportation route R1 through which a sheet P passes when the sheet P is transported toward the edge binder 43. The processing unit 4 is also provided with a second sheet transportation route R2 that branches from the first sheet transportation route R1 and that extends upward. Through the second sheet transportation route R2, a sheet P passes when the sheet P is transported toward the sheet stacking portion 46.

The processing unit 4 of the present exemplary embodiment is further provided with a third sheet transportation route R3 that branches from the first sheet transportation route R1 at a predetermined branch position. Through the third sheet transportation route R3, a sheet P passes when the sheet P is transported from the processing unit 4 toward the transportation unit 5. The third sheet transportation route R3, which is an example of a second transportation route, is formed so as to extend to a direction opposite to the sheet transport direction of the first sheet transportation route R1. The processing unit 4 is also provided with discharge rolls 461 and transportation rolls 462 that discharge to the sheet stacking portion 46 a sheet P transported along the second sheet transportation route R2.

The processing unit 4 is also provided with a switching unit 47 at a branching portion where the second sheet transportation route R2 branches from the first sheet transportation route R1. The switching unit 47 is swingable (rotatable) around a predetermined shaft. As mentioned in addition, the switching unit 47 has one end on the downstream side in the transport direction of a recording medium and the other end on the upstream side in the transport direction of a recording medium, and is rotatable around the one end placed on the downstream side in the transport direction of a sheet P.

The switching unit 47 changes from a state (a first state) where the switching unit 47 is retracted from the first sheet transportation route R1 to a state where the switching unit 47 is projected into the first sheet transportation route R1 (a state where the switching unit 47 transverses the first sheet transportation route R1, or a second state). Thereby, the switching unit 47 switches a transportation destination of a sheet P from the first sheet transportation route R1 to the second sheet transportation route R2, the sheet P having been transported from the image forming apparatus 2. The switching unit 47 also changes from the state where the switching unit 47 is projected into the first sheet transportation route R1 to the state where the switching unit 47 is retracted from the first sheet transportation route R1. Thereby, the switching unit 47 switches a transportation destination of a sheet P from the second sheet transportation route R2 to the first sheet transportation route R1, the sheet P having been transported from the image forming apparatus 2.

The processing unit 4 is also provided with a first guiding member 51 for guiding a sheet P transported on the first sheet transportation route R1, along the first sheet transportation route R1 on the downstream side of the switching unit 47 in the transport direction of the sheet P. The processing unit 4 is also provided with a second guiding member 52 for guiding the sheet P in the same manner, the second guiding member 52 being arranged at a position opposed to the first guiding member 51 with the first sheet transportation route R1 interposed therebetween.

The second guiding member 52 has a first guiding surface 52A and a second guiding surface 52B that guide a sheet P. The first guiding surface 52A is provided along the first sheet transportation route R1 on the downstream side of the switching unit 47 in the transport direction of the sheet P. The first guiding surface 52A is arranged at a position opposed to the first guiding member 51, and guides the sheet P transported on the first sheet transportation route R1.

The second guiding surface 52B is provided on the upstream side of the first guiding surface 52A in the transport direction of the sheet P so as to connect to the first guiding surface 52A, and is arranged at a position opposed to the switching unit 47 with the third sheet transportation route R3 interposed therebetween. The second guiding surface 52B is provided so as to separate from the first sheet transportation route R1 along with a move toward the upstream side in the sheet transport direction of the first sheet transportation route R1. As mentioned in addition, the second guiding surface 52B is provided with an inclination with respect to the horizontal direction. Furthermore, the second guiding surface 52B is arranged below the third sheet transportation route R3 and is formed along the third sheet transportation route R3.

Now, a description is given of the edge binder 43, which is an example of a binding unit. The edge binder 43 of the present exemplary embodiment is arranged on the downstream side of a connecting portion between the first sheet transportation route R1 and the third sheet transportation route R3, in the transport direction of a sheet P of the first sheet transportation route R1. The edge binder 43 is provided with: a compiler 431 on which sequentially transported sheets P are stacked; and exit rolls 432 that are a pair of rollers discharging a sheet P toward the compiler 431. The edge binder 43 is also provided with a main paddle and a sub paddle that rotate to push the trailing edge of each sheet P toward an end guide 431A of the compiler 431. Illustration of the paddles is omitted.

The edge binder 43 further includes an ejection roll 433 for transporting, to the sheet stacking member 45 through a discharge outlet 411 formed in the housing 41, a bundle of sheets that is accumulated at the compiler 431 and subjected to a binding process by a stapler 435. The edge binder 43 is further provided with a pressing roll 436 that is arranged to be in press contact with the bundle of sheets when the bundle of sheets is discharged by the ejection roll 433. The pressing roll 436 is retracted upward when a bundle of sheets is not discharged by the ejection roll 433.

Now, a description is given of an operation of the edge binder 43. When the edge binder 43 performs a binding process, the switching unit 47 defines the first sheet transportation route R1 as a transportation destination of a sheet P. Then, sheets P sequentially transported from the image forming apparatus 2 arrive at the compiler 431 by way of the first sheet transportation route R1, resulting in generation of a bundle of sheets composed of the plural sheets P, on the compiler 431. Next, an edge of the generated bundle of sheets is subjected to a binding process by the stapler 435. After that, the pressing roll 436 proceeds to the bundle of sheets, while the ejection roll 433 rotates. This causes the bundle of sheets to be stacked on the sheet stacking member 45.

Next, a description is given of the transportation unit 5. The transportation unit 5 of the present exemplary embodiment is provided with a housing 60 that has four side surfaces arranged so as to be perpendicular to one another and is formed into a rectangular parallelepiped, as with the processing unit 4. The transportation unit 5 is also provided with a first sheet transportation route R61 through which a sheet P having been transported from the image forming apparatus 2 passes when the sheet P is transported toward the processing unit 4. The transportation unit 5 is further provided with a second sheet transportation route R62 that connects to the third sheet transportation route R3 provided for the processing unit 4. A sheet P having been transported by way of the third sheet transportation route R3 passes through the second sheet transportation route R62.

The transportation unit 5 is further provided with first transportation rolls 61 for transporting a sheet P on the first sheet transportation route R61 toward the processing unit 4. On the second sheet transportation route R62, a punching unit 65 is also provided that performs a punching process on a sheet P having been transported by way of the third sheet transportation route R3 of the processing unit 4. On the second sheet transportation route R62, second transportation rolls 62 are further provided that transport a sheet P on the second sheet transportation route R62 to the punching unit 65. On the downstream side of the punching unit 65 in the transport direction of a sheet P of the second sheet transportation route R62, a touch portion 66 is further provided which is touched by the leading edge of each sheet P transported along the second sheet transportation route R62.

FIGS. 2A to 3B are diagrams showing an action of each component at the time when the punching process is performed by the punching unit 65.

Figure 2B:
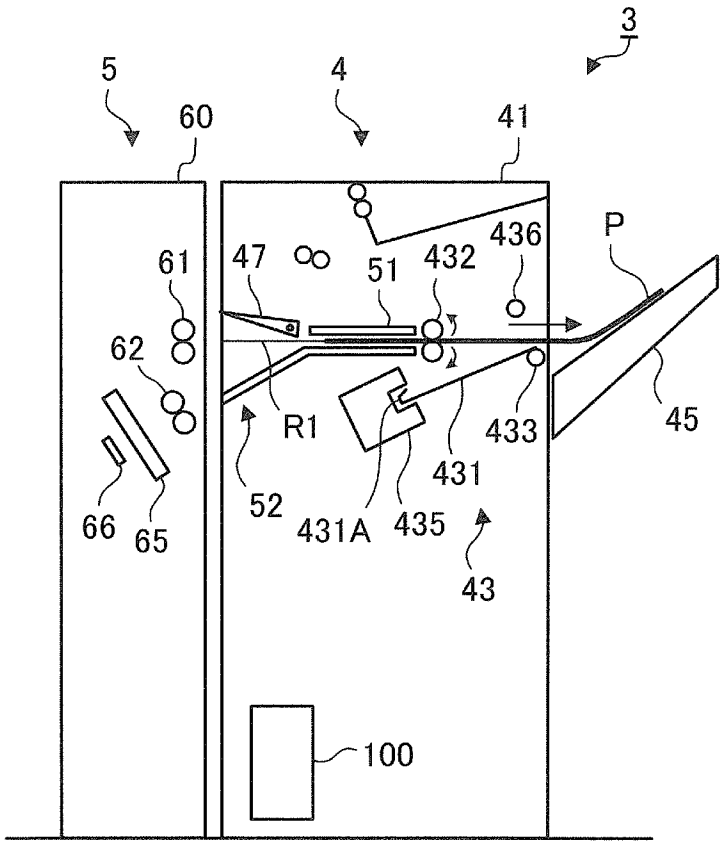
FIGS. 2A to 3B are diagrams showing an action of each component at the time when the punching process is performed by the punching unit.
Figure 2A:
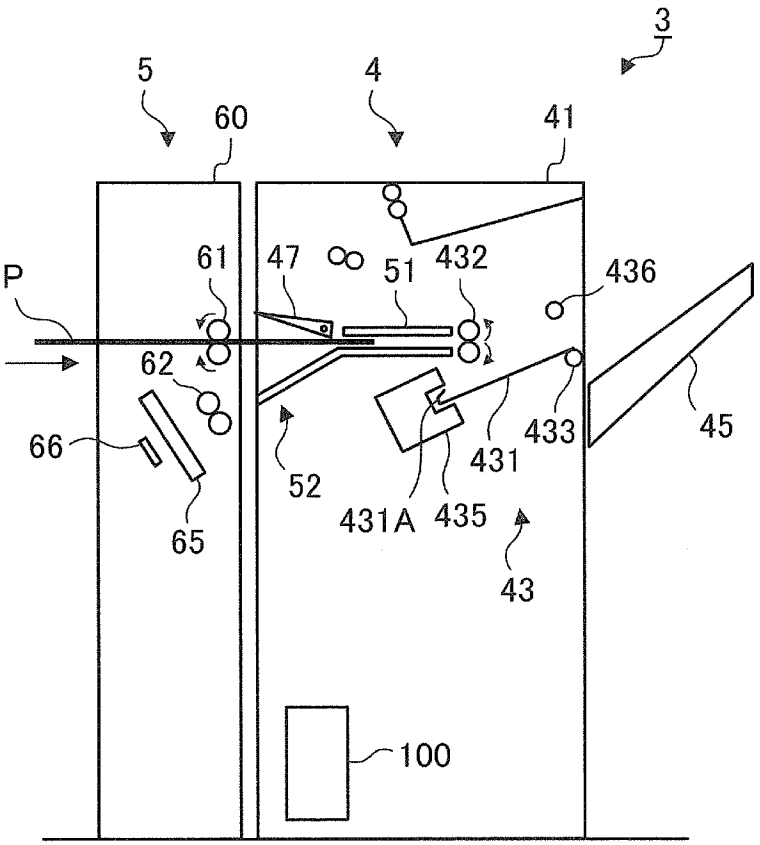

As shown in FIG. 2A, when the punching unit 65 performs a punching process, the first transportation rolls 61 in the transportation unit 5 are first driven to rotate while the exit rolls 432 in the processing unit 4 are driven to rotate, causing a sheet P to be transported toward the downstream side. On this occasion, the switching unit 47 is retracted from the first sheet transportation route R1. For this reason, the sheet P having been entered the processing unit 4 moves toward the downstream side along the first sheet transportation route R1, as shown in FIG. 2B.

Figure 3B:
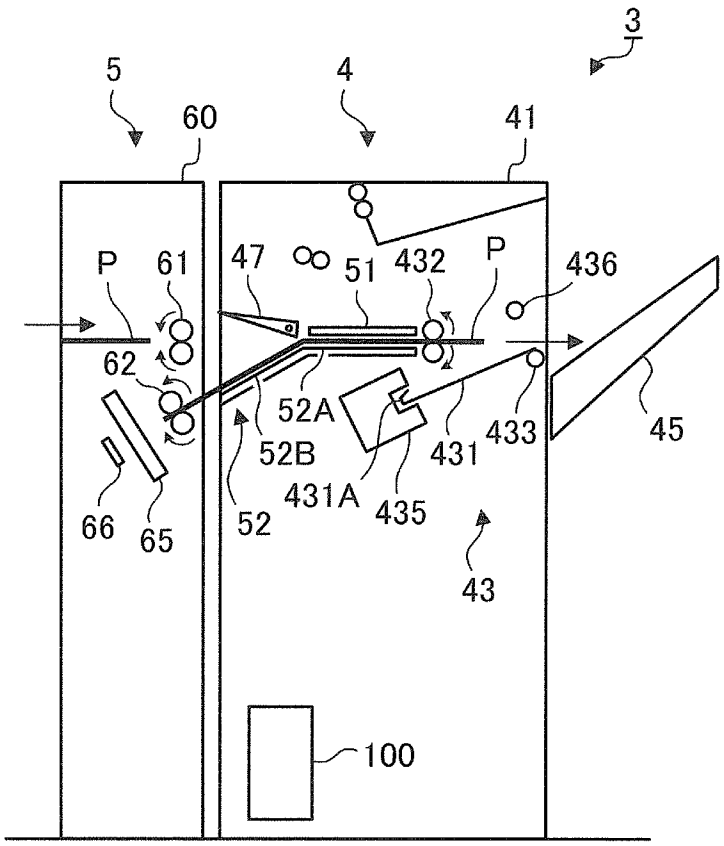
Figure 3A:
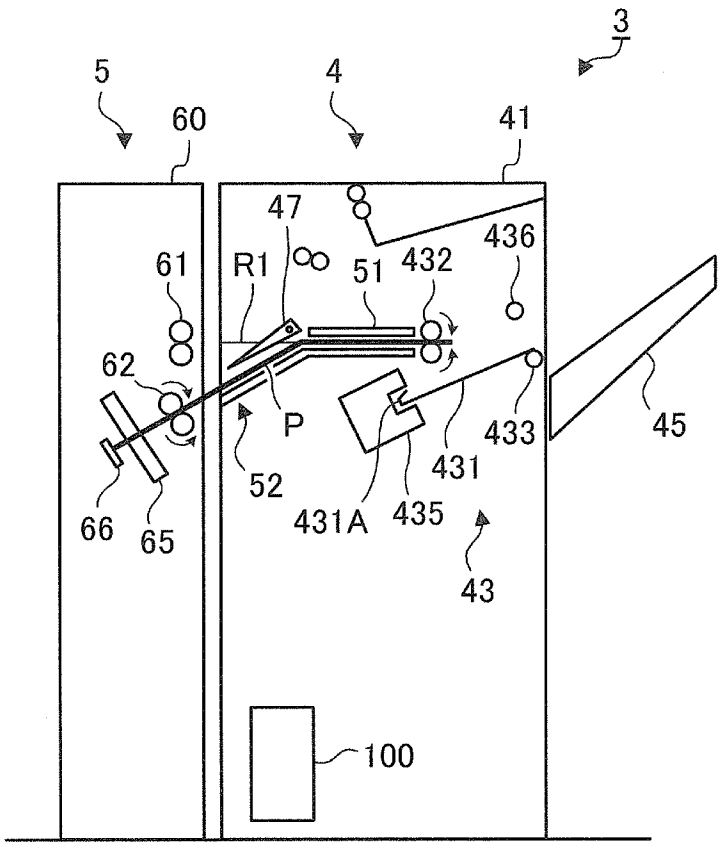

After that, in the present exemplary embodiment, the switching unit 47 is rotated so as to be in a state (a transverse state) where the switching unit 47 is projected into the first sheet transportation route R1. More specifically, as shown in FIG. 2B, the switching unit 47 is rotated after the trailing edge of the sheet P passes by the switching unit 47. As shown in FIG. 3A, this leads to a state where the switching unit 47 is projected into the first sheet transportation route R1. After that, the exit rolls 432, which function as a part of a transporting unit, are reversed while rotational drive of the second transportation rolls 62 is started, as shown in FIG. 3A.

This causes the moving direction of the sheet P to reverse. The sheet P comes to be guided by the switching unit 47, and be transported along the third sheet transportation route R3 provided for the processing unit 4 and the second sheet transportation route R62 provided for the transportation unit 5. As mentioned in addition, in the present exemplary embodiment, the leading edge of the sheet P whose moving direction is reversed contacts the switching unit 47 that is projected into the first sheet transportation route R1, and thereby the sheet P is fed into the third sheet transportation route R3. More specifically, in the present exemplary embodiment, the sheet P is fed into the third sheet transportation route R3 by using the switching unit 47 without providing a dedicated guide member for feeding the sheet P into the third sheet transportation route R3.

After that, in the present exemplary embodiment, as shown in FIG. 3A, the leading edge of the sheet P (a side located in the forefront) touches the touch portion 66. Furthermore, in the present exemplary embodiment, transportation of the sheet P caused by the exit rolls 432 and the second transportation rolls 62 is temporarily halted after the leading edge of the sheet P touches the touch portion 66. Next, the punching unit 65, which is an example of a punching unit, is driven to perform a punching process on the sheet P. This leads to formation of a through-hole in the sheet P. In the punching process, a pin (not shown) that is provided so as to be capable of advancing and retracting with respect to the sheet P and has a blade at the tip thereof proceeds to the sheet P and pierces the sheet P.

Next, in the present exemplary embodiment, a discharging process of the sheet P is performed. More specifically, as shown in FIG. 3B, the exit rolls 432 and the second transportation rolls 62 are rotated, and the sheet P is transported toward the edge binder 43 provided for the processing unit 4. As mentioned in addition, the sheet P is put back in the first sheet transportation route R1 and moves along the first sheet transportation route R1 toward the downstream side. After that, the sheet P is placed on the compiler 431, and then is further transported toward the downstream side by the ejection roll 433 and the pressing roll 436. As mentioned in addition, after the sheet P is placed on the compiler 431, the pressing roll 436 proceeds toward the ejection roll 433, and then the ejection roll 433 and the pressing roll 436 transport the sheet P toward the downstream side. The sheet P is then stacked on the sheet stacking member 45.

In the above-described example, a description is given of a case in which the pressing roll 436 is caused to proceed to the ejection roll 433, thereby transporting the sheet P toward the downstream side. However, bringing the pressing roll 436 and the ejection roll 433 into contact with each other from the beginning and feeding the sheet P into the contact portion between the pressing roll 436 and the ejection roll 433 also allows the sheet P to be transported toward the downstream side. In the above, a description is given of a punching process. However, if a staple process is also performed in addition to the punching process, a binding process is performed by the stapler 435 after plural sheets P subjected to punching are accumulated on the compiler 431. Then, the sheets P composing a bundle of sheets are stacked on the sheet stacking member 45.

In the above, a description is given of a punching process performed by the punching unit 65. However, if there is no punching process, the sheet P is transported toward the downstream side along the first sheet transportation route R1 or the second sheet transportation route R2 without being processed. As mentioned in addition, the sheet P is fed into neither the third sheet transportation route R3 of the processing unit 4 nor the second sheet transportation route R62 of the transportation unit 5, and the sheet P is transported toward the downstream side along the first sheet transportation route R1 or the second sheet transportation route R2 without being processed. In this case, the sheet P does not pass through the punching unit 65.

The punching unit 65 may be provided for the first sheet transportation route R1, instead of a transportation route branched from the first sheet transportation route R1, which is the main transportation route, as in the present exemplary embodiment. However, in this case, the quality of a sheet P is likely to degrade.

For the punching unit 65, many metallic components are used. Meanwhile, since a sheet P placed in the first sheet transportation route R1 has passed through the fixing device 2E (see FIG. 1) that heats and pressurizes the sheet P, the sheet P emits vapor. In this case, condensation occurs at the punching unit 65, and moisture adheres to the punching unit 65. For this reason, if the punching unit 65 is provided for the first sheet transportation route R1, the sheet P passes through the punching unit 65 where condensation has occurred. Then, moisture of the punching unit 65 is transferred to the sheet P, which may lead to degradation of the quality of the sheet P.

Additionally, if the punching unit 65 is provided for the first sheet transportation route R1, which is provided for the processing unit 4, a sheet P requiring no punching process also passes through the punching unit 65. This passing is likely to cause degradation of the quality of the sheet P. Since the punching unit 65 has a hole for the pin piercing the sheet P to run therethrough, the sheet P may get caught in this hole. Getting caught in this hole may damage the sheet P.

Meanwhile, there are many types of sheets P, some of which are hardly subjected to the punching process. For example, coated paper or the like having a shine is hardly subjected to the punching process. If the punching unit 65 is provided for the first sheet transportation route R1, which is provided for the processing unit 4, such a sheet P that is not to be subjected to the punching process also passes through the punching unit 65.

Accordingly, in the present exemplary embodiment, the punching unit 65 is provided for a branched transportation route that is branched from the first sheet transportation route R1, and a sheet P that is to be subjected to the punching process is transported to the punching unit 65, as described above. As mentioned in addition, the sheet P is fed into a location away from the first sheet transportation route R1, and the punching process is performed by using the punching unit 65 provided at the location away from the first sheet transportation route R1. Thereby, a sheet P requiring no punching process does not pass through the punching unit 65.

Since providing the punching unit 65 for the second sheet transportation route R62 of the transportation unit 5 as in the present exemplary embodiment makes the distance from the fixing device 2E (see FIG. 1) to the punching unit 65 increase, much moisture is emitted from a sheet P before the sheet P arrives at the punching unit 65. Thus, the configuration of the present exemplary embodiment is unlikely to cause condensation in the punching unit 65 and degradation of the quality of the sheet P associated with the condensation.

In the present exemplary embodiment, the leading edge of a sheet P touches the touch portion 66, as described above. Additionally, in the present exemplary embodiment, the punching process is performed by the punching unit 65 while the leading edge of a sheet P touches the touch portion 66. Thereby, skew of the sheet P (an inclination of the sheet P with respect to the transport direction) is corrected, and the punching process is hardly performed on a location other than a predetermined location.

Figure 4:
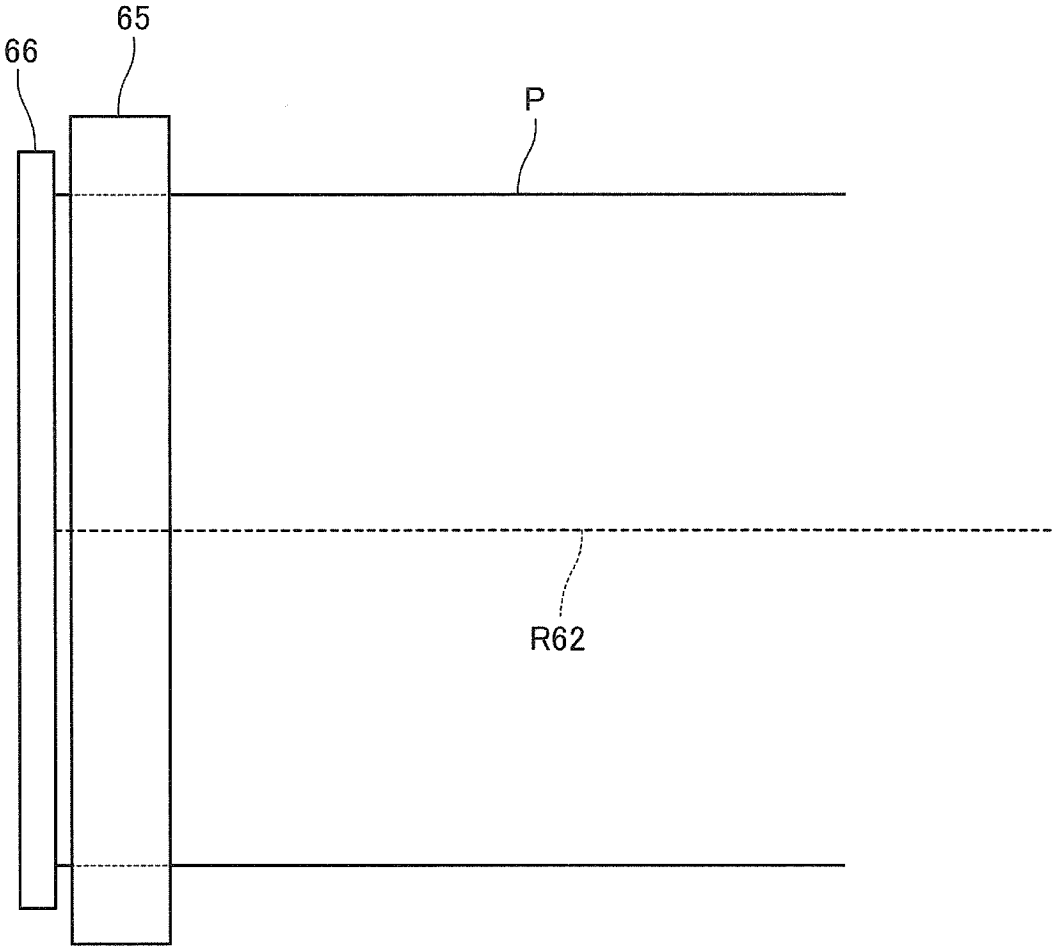
FIG. 4 is a diagram showing a configuration around the punching unit.

The punching unit 65 of the present exemplary embodiment is provided at an end of the second sheet transportation route R62 as shown in FIG. 4 (a diagram showing a configuration around the punching unit 65), although a description thereof is omitted in the above. As mentioned in addition, the punching unit 65 is provided so as to be opposed to that edge of a sheet P which is located on the downstream side of the transport direction. For example, if the punching unit 65 is provided on the way of the transportation route of a sheet P as in a case where the punching unit 65 is provided for the first sheet transportation route R1 of the processing unit 4, the entire sheet P passes through the punching unit 65 and thus the sheet P may be damaged over the entire sheet P.

As mentioned in addition, the sheet P may be damaged from one edge to the other edge thereof. Additionally, if condensation occurs at the punching unit 65, moisture may adhere to the sheet P from one edge to the other edge thereof. Meanwhile, in the present exemplary embodiment, not the entire sheet P but a part (only one edge) of the sheet P passes through the punching unit 65. Accordingly, in the present exemplary embodiment, even if the sheet P is damaged, the damaged area is small. Even if moisture due to condensation adheres to the sheet P, the adhering area is small.

In the above-described exemplary embodiment, a description is given of a case in which more than a half region of a sheet P is fed into the branched transportation route formed of the third sheet transportation route R3 and the second sheet transportation route R62. However, if the punching unit 65 is provided near the connecting portion at which the branched transportation route and the first sheet transportation route R1 connect to each other, only the leading edge of a sheet P (a part thereof) may be fed into the branched transportation route.

In the above, the edge binder 43 performs no process on the occasion of the punching process of the punching unit 65. However, a process of the edge binder 43 may be performed in parallel with the punching process of the punching unit 65. As mentioned in addition, in the midst of the binding process of the edge binder 43, a sheet P may be fed into the above-described branched transportation route and be subjected to the punching process. More specifically, in the present exemplary embodiment, since the edge binder 43 is provided on the downstream side of the connecting portion between the above-described branched transportation route and the first sheet transportation route R1 in the sheet transport direction of the first sheet transportation route R1, a sheet P may be fed into the above-described branched transportation route even in the midst of the process of the edge binder 43.

As described above, in the present exemplary embodiment, a sheet P that is not to be subjected to the punching process by the punching unit 65 is not fed into the third sheet transportation route R3 and the second sheet transportation route R62, but is transported toward the downstream side along the first sheet transportation route R1 (or the second sheet transportation route R2 in some cases) without being processed. If the edge binder 43 performs a process on the occasion of transportation of a sheet P along the first sheet transportation route R1 in this manner, the sheet P cannot be transported to the downstream side. In this case, the sheet P needs to be temporarily halted on the upstream side of the edge binder 43.

In the present exemplary embodiment, if the sheet P is temporarily halted on the upstream side of the edge binder 43 in this manner, a process is performed to feed the sheet P into the third sheet transportation route R3 and the second sheet transportation route R62. As mentioned in addition, the sheet P is not merely held on the first sheet transportation route R1, but is fed into the third sheet transportation route R3 and the second sheet transportation route R62. More specifically, a sheet P that is not to be subjected to the punching process by the punching unit 65 is not essentially fed into the third sheet transportation route R3 and the second sheet transportation route R62; however, when the process of the edge binder 43 prevents transportation toward the downstream side, the sheet P is temporarily fed into the third sheet transportation route R3 and the second sheet transportation route R62. Then, after the process of the edge binder 43 is finished, the sheet P is put back in the first sheet transportation route R1 and is transported toward the edge binder 43.

If a sheet P is held on the first sheet transportation route R1 as described above, another sheet P transported subsequently to the sheet P may be inserted below the sheet P. In this case, order of pages may be exchanged. If a sheet P is fed into the third sheet transportation route R3 and the second sheet transportation route R62 as described above, the subsequently transported sheet P is placed above the held sheet P. In this case, order of pages is prevented from exchanging.

In the above, a description is given of a case in which sheets P are subjected to the punching process one by one. However, plural sheets P may be collectively subjected to the punching process. More specifically, sheets P sequentially transported from the upstream side are held on the first sheet transportation route R1 to generate a bundle of sheets, while the bundle of sheets is fed into the third sheet transportation route R3 and the second sheet transportation route R62, allowing the plural sheets P to be collectively subjected to the punching process.

Hereinafter, a description is given of an action of each component in the case where plural sheets P are collectively subjected to the punching process.

Figure 5B:
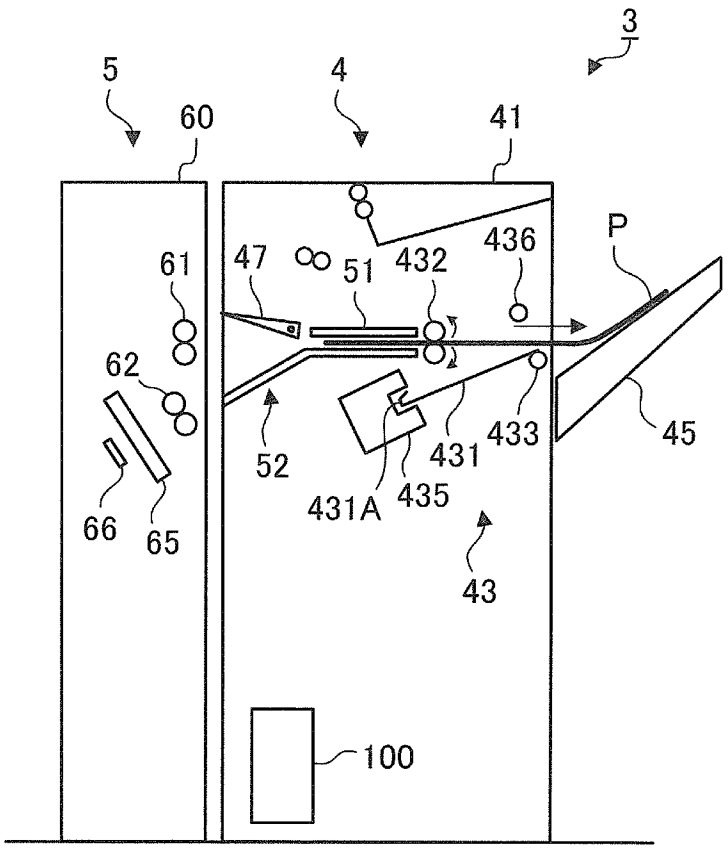
FIGS. 5A to 7B are diagrams showing an action of each component at the time when the punching process is performed on plural sheets.
Figure 5A:
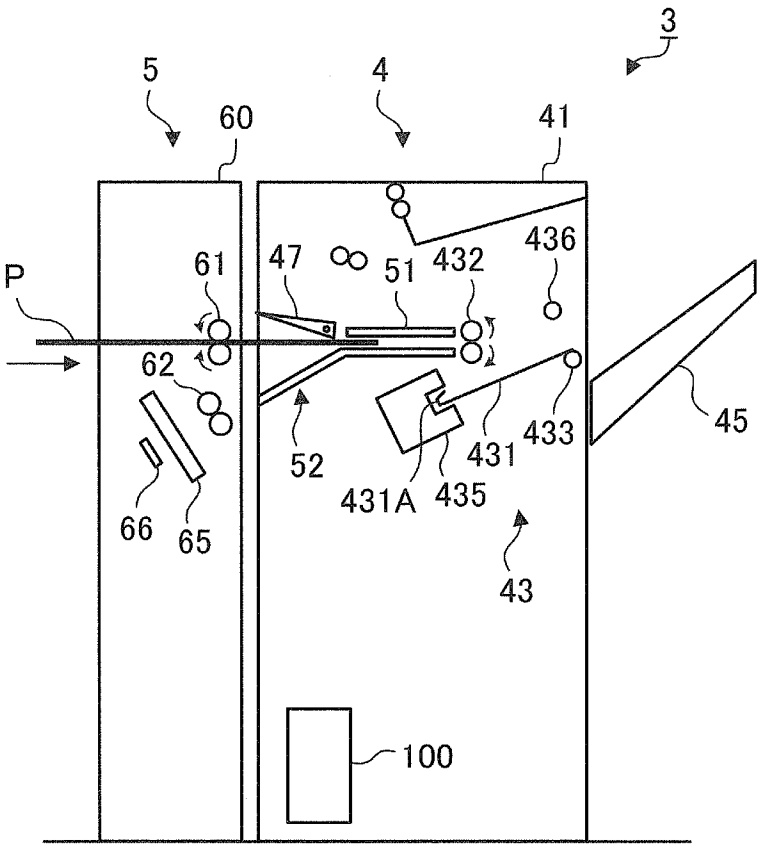

FIGS. 5A to 7B are diagrams showing an action of each component at the time when the punching process is performed on plural sheets P. In this case, the first sheet P is first transported from the image forming apparatus 2, as shown in FIG. 5A. The first sheet P is transported to the downstream side of the switching unit 47, and is temporarily halted on the downstream side of the switching unit 47, as shown in FIG. 5B. After that, the switching unit 47 is driven and is projected into the first sheet transportation route R1, in the same manner as described above.

Figure 6B:
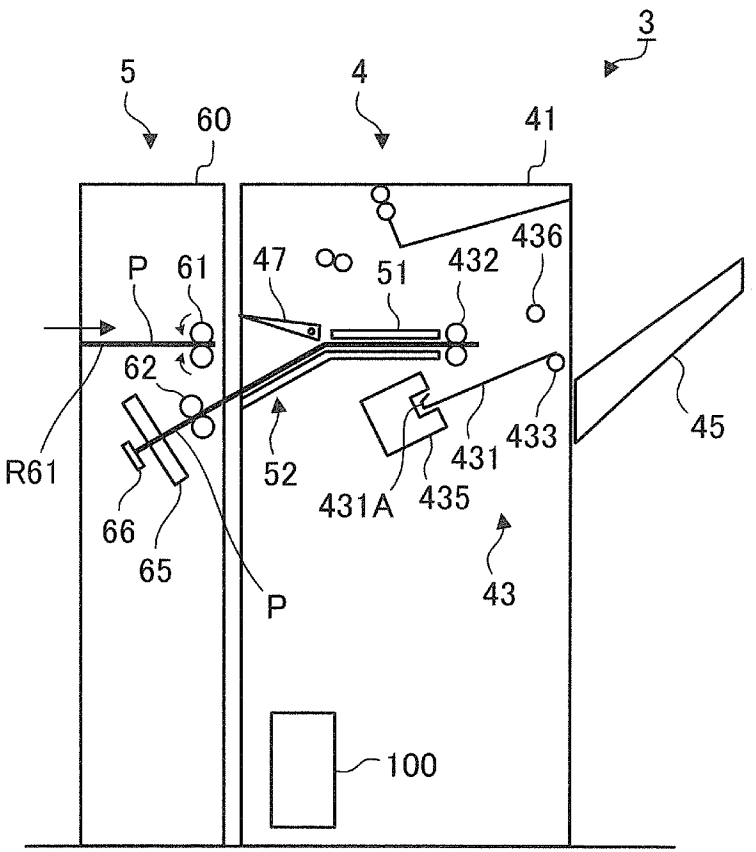
Figure 6A:
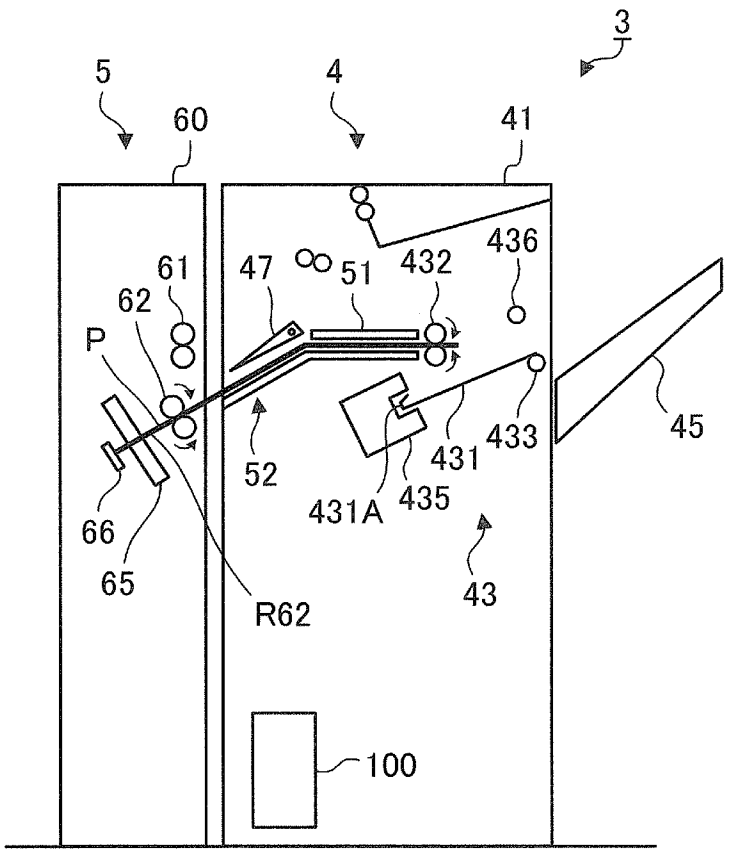

After that, the exit rolls 432 are reversed, and rotational drive of the second transportation rolls 62 is started. Thereby, the sheet P is fed into the third sheet transportation route R3 of the processing unit 4 and the second sheet transportation route R62 of the transportation unit 5, as shown in FIG. 6A. This causes the sheet P partially fed into the third sheet transportation route R3 and the second sheet transportation route R62 to be held on the first sheet transportation route R1. After that, the second sheet P is transported along the first sheet transportation route R61 provided for the transportation unit 5, as shown in FIG. 6B. In the present exemplary embodiment, rotation of the exit rolls 432 is restarted when the second sheet P arrives at the exit rolls 432.

Figure 7B:
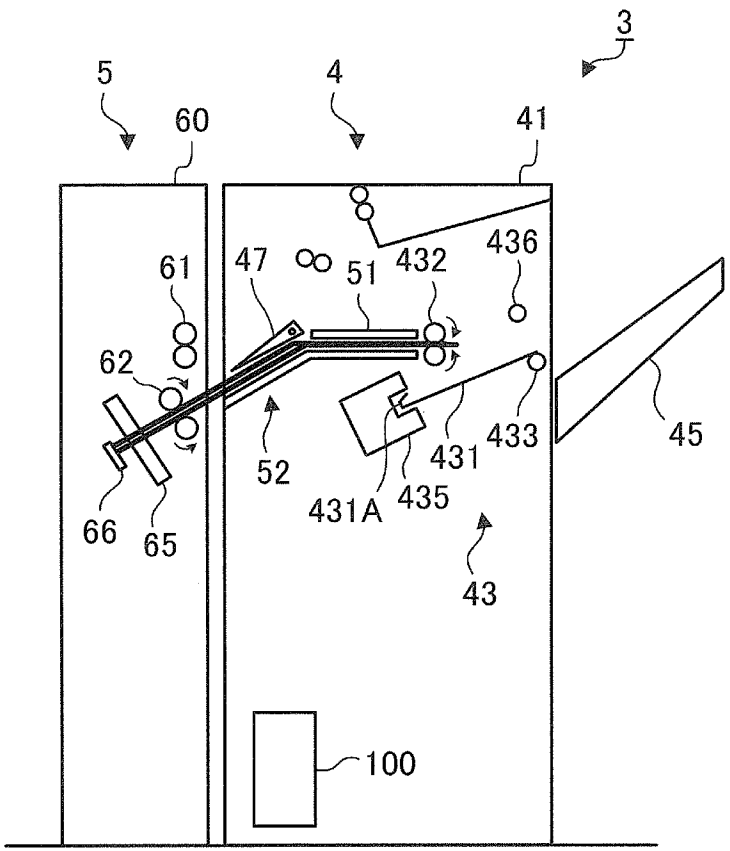
Figure 7A:
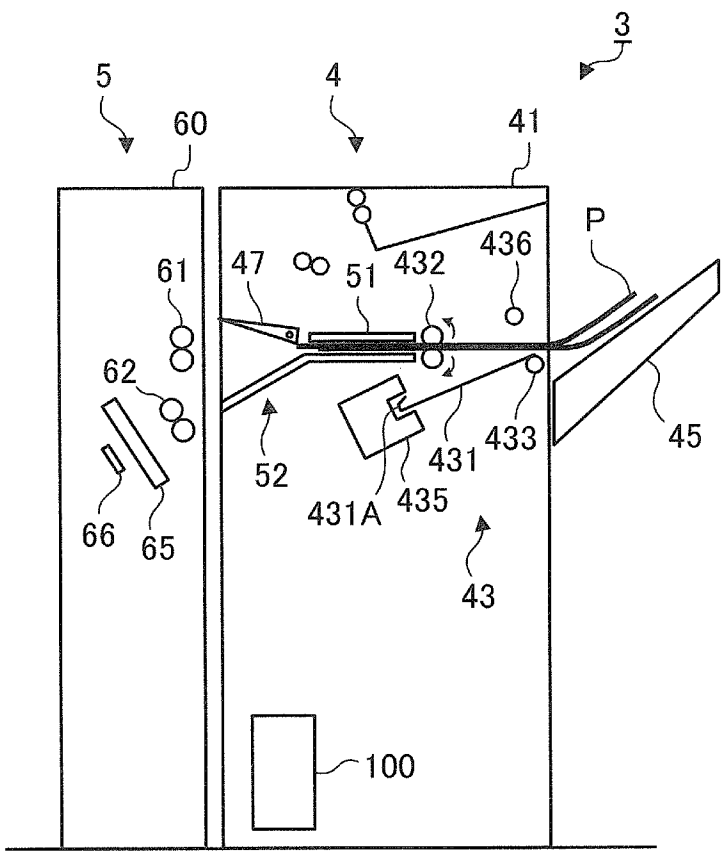

Thereby, the sheets P are transported toward the downstream side with the first sheet P and the second sheet P overlapped with each other, as shown in FIG. 7A. As mentioned in addition, a bundle of sheets composed of the two sheets P is generated and transported toward the downstream side. Next, in the present exemplary embodiment, after the trailing edges of the two sheets P pass through the switching unit 47, the switching unit 47 is rotated and projected into the first sheet transportation route R1.

In the present exemplary embodiment, when the above-described bundle of sheets composed of the two sheets P is generated, the first sheet P is fed into the second sheet transportation route R62 of the transportation unit 5, as described above. However, without such feeding into the second sheet transportation route R62, a bundle of sheets may be generated by transporting the first sheet P toward the upstream side along the first sheet transportation route R1. Specifically, the first sheet P is transported so as to be put back on the upstream side in the first sheet transportation route R1, while rotation of the exit rolls 432 is restarted when the second sheet P arrives at the exit rolls 432 in the same manner as described above. Thereby, the bundle of sheets composed of the two sheets P is generated.

If the first sheet P is transported so as to be put back on the upstream side in the first sheet transportation route R1 in this manner, the subsequently transported second sheet P may be inserted below the first sheet P in the same manner as described above. In this case, order of pages is exchanged. Accordingly, in the present exemplary embodiment, a process is performed to feed the first sheet P (the preceding sheet P) into the second sheet transportation route R62 of the transportation unit 5 as described above, thereby preventing the second sheet P from being inserted below the first sheet P.

In the present exemplary embodiment, after the bundle of sheets is generated, the exit rolls 432 are reversed again and rotational drive of the second transportation rolls 62 is started, as shown in FIG. 7B. Thereby, the two sheets P (the bundle of sheets) are fed into the second sheet transportation route R62 of the transportation unit 5, while the leading edge of each of the two sheets P touches the touch portion 66.

Next, the punching unit 65 is driven to perform the punching process on the two sheets P. This forms a through-hole piercing the two sheets P. After that, the exit rolls 432, the second transportation rolls 62 and the ejection roll 433 are rotated to transport the sheets P to the sheet stacking member 45, in the same manner as described above. Performing the punching process collectively on plural sheets P as in the present exemplary embodiment may prevent the punched locations of the respective sheets P from being misaligned.

When the above-described two sheets P are transported to the sheet stacking member 45, the main paddle and the sub paddle (not shown) provided for the edge binder 43 may be rotated to cause the two sheets P to be bumped against the end guide 431A of the compiler 431, thereby performing a process to align the edges thereof. Also when one sheet P is discharged, the sheet P may be bumped against the end guide 431A. In this case, skew of the sheets P is corrected, and the stack of the sheets P is hardly disordered in the sheet stacking member 45. In the above, a description is given of a case in which the punching process is performed on two sheets P; however, a bundle of sheets composed of more than two sheets P may be generated by repeating the process shown in FIGS. 6B to 7B.

In the above, the position of the leading edge of each sheet P is aligned by using the touch portion 66. However, the position of each sheet P in the direction orthogonal to the transport direction of the sheet P may be aligned by pressing, against one side of the sheet P, a first moving member (not shown) that moves from the back side to the front side of the sheet on which FIG. 1 is drawn and by pressing, against the other side of the sheet P, a second moving member (not shown) that moves from the front side to the back side of the sheet on which FIG. 1 is drawn.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording medium processing apparatus comprising:

a first transportation route on which a recording medium is transported;

a second transportation route which branches from the first transportation route at a branch position;

a transporting unit provided on a downstream side of the branch position in a transport direction of the recording medium, the transporting unit (i) feeding at least a part of a first recording medium, which is transported on the first transportation route and passed through the branch position, into the second transportation route, (ii) transporting the fed first recording medium and a second recording medium with an overlap in the transport direction on the first transportation route to generate a bundle of the fed first recording medium and the second recording medium and (iii) feeding the transported bundle which passed through the branch position into the second transportation route; and a punching unit that is provided at an end of the second transportation route and punches the fed bundle with one punching process, wherein a punching process of the punching unit is performed in parallel with a process of an edge binder.

2. The recording medium processing apparatus according to claim 1, wherein the transporting unit stops feeding of the fed first recording medium, starts transporting of the fed first recording medium in the transport direction on the first transportation route after the second recording medium passes through the branch position and before the second recording medium reaches the transporting unit, and transports the transported first recording medium and the second recording medium with an overlap in the transport direction on the first transportation route to generate a bundle of the transported first recording medium and the second recording medium.

3. The recording medium processing apparatus according to claim 1, wherein the transporting unit does not feed, into the second transportation route, a recording medium that is not to be subjected to the punching process by the punching unit.

4. The recording medium processing apparatus according to claim 1, further comprising a touch portion that is touched by a leading edge of the recording medium fed into the second transportation route, wherein the punching unit punches the bundle of the first recording medium and the second recording medium in a state where a leading edge of the first recording medium and a leading edge of the second recording medium touch the touch portion.

5. The recording medium processing apparatus according to claim 1, further comprising a controller which controls the punching process of the punching unit to be performed in parallel with the process of the edge binder.

6. An image forming system comprising:

an image forming unit that forms an image on a recording medium;

a first transportation route on which the recording medium is transported, the recording medium having the image formed thereon by the image forming unit;

a second transportation route which branches from the first transportation route at a branch position;

a transporting unit provided on a downstream side of the branch position in a transport direction of the recording medium, the transporting unit (i) feeding at least a part of a first recording medium, which is transported on the first transportation route and passed through the branch position, into the second transportation route, (ii) transporting the fed first recording medium and a second recording medium with an overlap in the transport direction on the first transportation route to generate a bundle of the fed first recording medium and the second recording medium and (iii) feeding the transported bundle which passed through the branch position into the second transportation route; and a punching unit that is provided at an end of the second transportation route and punches the fed bundle with one punching process, wherein a punching process of the punching unit is performed in parallel with a process of an edge binder.

7. The image forming system according to claim 6, wherein the transporting unit stops feeding of the fed first recording medium, starts transporting of the fed first recording medium in the transport direction on the first transportation route after the second recording medium passes through the branch position and before the second recording medium reaches the transporting unit, and transports the transported first recording medium and the second recording medium with an overlap in the transport direction on the first transportation route to generate a bundle of the transported first recording medium and the second recording medium.

8. The image forming system according to claim 6, further comprising a touch portion that is touched by a leading edge of the recording medium fed into the second transportation route, wherein the punching unit punches the bundle of the first recording medium and the second recording medium in a state where a leading edge of the first recording medium and a leading edge of the second recording medium touch the touch portion.

9. The image forming system according to claim 6, further comprising a switching unit provided at the branch position, the switching unit changing from a first state where the switching unit is retracted from the first transportation route to a second state where the switching unit is projected into the first transportation route and the switching unit switching a transportation destination of a recording medium from the first transportation route to the second transportation route, wherein if a recording medium is transported on the first transportation route in a direction opposite to the transport direction and contacts the switching unit in the second state, the transporting unit feeds the contacted recording medium into the second transportation route.

10. The image forming system according to claim 6, further comprising the edge binder provided on the downstream side of the branch position in the transport direction of the recording medium and that binds a plurality of recording medium which is transported on the first transportation route.

11. The image forming system according to claim 6, further comprising the edge binder provided on the downstream side of the branch position in the transport direction of the recording medium and that binds a plurality of recording medium which is transported on the first transportation route, wherein if the edge binder is performing a binding process when a recording medium that is not to be subjected to the punching process by the punching unit is transported toward the edge binder, the transporting unit temporarily feeds at least a part of the recording medium into the second transportation route, and after the binding process is finished, the transporting unit transports the recording medium fed into the second transportation route toward the edge binder.

* * * * *